US007121032B2

(12) United States Patent
Daul et al.

(10) Patent No.: US 7,121,032 B2
(45) Date of Patent: Oct. 17, 2006

(54) HYDRAULASTIC RECOIL PAD FOR A SHOULDER FIREARM

(75) Inventors: Terrance E. Daul, Hamburg, NY (US); Jeffrey T. Kelly, Orchard Park, NY (US); Daniel C. Radice, Eden, NY (US); Brian C. Bucholtz, Lakeview, NY (US); Thomas J. Miller, Clarence, NY (US)

(73) Assignee: Enidine, Inc., Orchard Park, NY (US)

( * ) Notice: Subject to any disclaimer, the term of this patent is extended or adjusted under 35 U.S.C. 154(b) by 0 days.

(21) Appl. No.: 11/050,318

(22) Filed: Feb. 3, 2005

(65) Prior Publication Data

US 2006/0168869 A1 Aug. 3, 2006

(51) Int. Cl.
*F41A 21/00* (2006.01)

(52) U.S. Cl. ..... 42/1.06; 42/74

(58) Field of Classification Search ..... 42/1.06, 42/74; 89/42.01, 43.01
See application file for complete search history.

(56) References Cited

U.S. PATENT DOCUMENTS

| | | | | | |
|---|---|---|---|---|---|
| 837,601 | A * | 12/1906 | Behr | 42/74 |
| 2,344,752 | A * | 3/1944 | Utz | 42/74 |
| 3,001,312 | A * | 9/1961 | Campbell | 42/74 |
| 3,039,222 | A * | 6/1962 | Hoge | 42/74 |
| 3,176,424 | A * | 4/1965 | Hoge | 42/74 |
| 3,209,482 | A * | 10/1965 | Kuzma et al. | 42/74 |
| 3,233,354 | A | 2/1966 | Ahearn | |
| 3,371,442 | A * | 3/1968 | Carlson | 42/74 |
| 3,707,797 | A * | 1/1973 | Ruth | 42/74 |
| 3,714,726 | A * | 2/1973 | Braun | 42/74 |
| 4,439,943 | A * | 4/1984 | Brakhage | 42/74 |
| 4,663,877 | A * | 5/1987 | Bragg | 42/74 |
| 5,031,348 | A * | 7/1991 | Carey | 42/74 |
| 2003/0154640 | A1 * | 8/2003 | Bragg | 42/74 |
| 2004/0031182 | A1 * | 2/2004 | Bentley | 42/74 |

OTHER PUBLICATIONS

Excerpt from website http://www.outdoorsupplies.co.nz/recoilpads.htm; Hunting and Outdoor Supplies—Collings and Bradey; Carterton, New Zealand; dated Oct. 2001.
Excerpt from website http://www.riflesrus.com/recoil/recoilpads/html; Answer Products Co.; 2003.
Excerpts from website http://www.100straight.com/home.htm; 100 Straight Products Inc.; Sturgis, SD website; copyright 1999.

* cited by examiner

*Primary Examiner*—Michael J. Carone
*Assistant Examiner*—Benjamin P. Lee
(74) *Attorney, Agent, or Firm*—Peter J. Bilinski

(57) ABSTRACT

A recoil pad for a shoulder firearm includes at least one piston member that is caused to move axially from an initial axial position to a second axial position upon application of the recoil force from the firearm. The axial movement of the piston member causes fluid movement within a column relative to a variable or fixed orifice area wherein the fluid movement causes resistance that absorbs the energy. A mechanical and/or hydraulic and/or elastomeric feature returns the piston to the initial axial position upon cessation of the applied recoiling force.

14 Claims, 3 Drawing Sheets

HYDRAULASTIC RECOIL PAD FOR A SHOULDER FIREARM

FIELD OF THE INVENTION

This invention relates to the field of firearms, and more particularly to an improved recoil force reduction apparatus for a shoulder firearm, such as a rifle or shotgun, the apparatus including a combination of hydraulic and elastomeric features.

BACKGROUND OF THE INVENTION

It is commonly well known that shoulder firearms, such as rifles and shotguns, recoil suddenly and violently in a rearward direction when the firearm is discharged. The amount of resulting force that is felt by the shooter is jarring and is often uncomfortable, and to that end there have been numerous attempts that have been made in the field to devise a recoil reducing apparatus in an effort to dissipate the recoil force, rather than to have the shooter receive a sharp blow to the shoulder.

The types of recoil reducing apparatus that are presently known have included numerous mechanical and/or pneumatic systems and hydraulic type devices. For example, Ahearn, U.S. Pat. No. 3,233,354, relates to a class of hydraulic-type recoil reducing apparatus. According to the Ahearn patent, a recoil apparatus interconnects the butt portion (the portion of the stock which engages the shoulder of the shooter) and the forepiece of the stock. This apparatus includes a hydraulic cylinder and piston which axially reciprocates so as to permit hydraulic fluid contained in the cylinder to escape about the piston in order to permit relative movement between the two portions of the stock in a controlled manner and in which the recoil force is absorbed by the motion of the piston through the fluid.

A fundamental problem found in hydraulic type recoil reducing apparatus, such as described by Ahearn, is their insensitivity to certain factors, such as the type of ammunition used and the weight of the firearm itself. For example, a selection of different types of ammunition will often be commercially available for a particular caliber or gauge of the firearm, meaning that the shooter is free to select the ammunition most suited to his or her application. In addition, the shooter may select a particular type of ammunition in order to obtain particular ballistics or firing characteristics. Each of the preceding factors contribute to the recoil characteristics of the firearm and therefore may limit the effectiveness of the recoil reducer apparatus.

Therefore, attempts have been made in an effort to provide adjustability in such apparatus. U.S. Pat. No. 4,439,943 to Brakhage is an example of a recoil reducer apparatus that provides adjustability. In brief, this rather complex apparatus includes a pair of pistons, namely a primary piston and a secondary piston, which are provided within a hydraulic cylinder. A piston rod extends through the secondary piston and partially into the main piston through an aperture. The aperture according to this disclosure is frusto-conical to permit the attachment of a frusto-conical piston rod end. The pistons are supported to prevent rotation and a passage is formed between the frusto-conical portion of the aperture and one side of the main piston to permit fluid to pass therethrough during recoil. The secondary piston which is sealed to prevent fluid leakage provides a biasing force to return the apparatus (i.e., the main piston) to a neutral position. Turning of the piston rod changes the characteristics of the passage and therefore changes the damping characteristics of the apparatus as fluid passes through the piston when the firearm is discharged.

Other forms of recoil reducing apparatus include pads that are added to the shoulder firearm, the pads being at least partially defined by an elastomeric material. These devices, however, are able to provide only a fractional amount of energy absorption and are therefore only moderately effective.

SUMMARY OF THE INVENTION

It is therefore a primary object of the present invention to improve upon the above-noted deficiencies of the prior art.

It is another primary object of the present invention to provide a recoil pad that can be integrally or otherwise mounted to the stock of a rifle or other shoulder firearm that will provide energy absorption when the rifle is fired in order to reduce the impact or recoil force that is felt by the shooter.

It is yet another primary object of the present invention to provide a recoil pad in a manner that is relatively easy to manufacture and at a substantially lower cost than currently known devices of this type.

It is yet another primary object of the present invention to provide a recoil pad device that provides improved performance for a given pad deflection, as compared to other recoil pad devices.

It is still another primary object of the present invention to provide a recoil pad design that provides improved performance over a wide and diverse range of ammunitions.

Therefore and according to a preferred aspect of the present invention, there is provided a recoil pad for a shoulder firearm, said recoil pad being mounted to or integrated within the stock of a shoulder firearm. The recoil pad includes at least one internal cavity or chamber having a quantity of fluid contained therein and a piston assembly. Discharge of said firearm causes hydraulic orificing of the fluid through a fixed or variable orifice area caused by movement of the piston assembly through the chamber. This hydraulic orificing generates a force in the recoil pad and absorbs energy by transferring the energy into heat that is dissipated into the environment, rather than storing the energy and releasing same back into the firearm.

According to one version, the movement of the piston through the confines of a hydraulic fluid column causes a reduction in the volume retaining the hydraulic fluid and thus orificing of the fluid around the piston which produces a damping effect. Moreover and according to this version, a portion of the volume of hydraulic fluid contained within a first interior chamber into which the piston is moved is caused to be displaced from the first interior chamber to a second adjacent accumulator chamber. The accumulator chamber is sealed to the remainder of the recoil pad apparatus with the exception of the first chamber and already includes therein a quantity of air. The introduction of hydraulic fluid from the first chamber coupled with the movement of the piston assembly causes the air within the accumulator chamber to compress. According to another version, the recoil pad comprises a piston assembly including a piston head and a pair of piston rods extending therethrough. According to this version, the recoil force causes the piston head to be moved through a fluid column wherein the hydraulic orificing occurs either through or around the piston head.

According to the invention, the recoil pad combines at least one hydraulic element, such as the above noted piston, as well as at least one elastomeric element in order to effectively absorb the recoil energy associated with the firing of a shoulder firearm, such as a rifle. As noted, the hydraulic element preferably includes a hydraulic fluid into which the piston is brought in contact. As the firearm discharges, the hydraulic fluid is pressurized within the confines of the pad and hydraulic fluid is orificed around or through the piston head, thereby creating a resisting force.

In addition, the at least one elastomeric element of the herein described recoil pad absorbs a small portion of the energy and creates a preload force to insure the recoil pad will not stroke until a predetermined force is exceeded. Moreover, the elastomeric element also provides the biasing force required to return the recoil pad for the next firing of the firearm after the energy absorption cycle has been completed. The recoil pad can also include, for example, a coil spring or other means to provide the necessary return force, such as that produced by a compressed volume of air in an adjacent accumulator chamber by the piston.

An advantage provided by the present invention is that the design of the above described recoil pad, through the hydraulic orificing of fluids, can be used with a wide range of ammunitions, thereby producing a velocity sensitive damping force. The stock can be modified to contain the recoil pad within the stock of the firearm or can be separately mounted as an accessory component.

Another advantage of the present invention is that through hydraulic orificing of fluid and by varying the orifice area versus the deflection of the recoil pad an improved performance for a given pad deflection is provided, as compared to prior art recoil pad devices.

Another advantage of the present invention is the ease of manufacture due to the reduced number of components required, and therefore the herein described apparatus can be manufactured and sold at lower cost.

These and other objects, features and advantages of the present invention will become readily apparent from the following Detailed Description that should be read in conjunction with the accompanying drawings.

DETAILED DESCRIPTION

The following description relates to a hydraulastic recoil pad for a shoulder firearm, Such as a rifle or shotgun in accordance with a number of embodiments. It should be readily apparent, however, that the herein described recoil pad can be similarly used with other commercially available shoulder firearms, other than specifically described herein. In addition and throughout the description which follows, several terms are used in order to provide a suitable frame of reference with regard to the accompanying drawings, such as "front", "back", "top", "bottom", and the like. These terms, however, are not intended to be over limiting or to restrict the scope of the invention in accordance with the present claims, except where specifically indicated.

The term "hydraulastic" as used herein refers to a combination of hydraulic and elastomeric features that are present in the recoil pad in accordance with the present invention. The term "proximal" as used herein for purposes of this discussion refers to the side of the recoil pad apparatus or direction that is in relation closer to the shoulder of the shooter and the term "distal" as used herein for purposes of this discussion refers to the side of the recoil pad apparatus or direction that is in relation closer to the rifle or shoulder firearm.

Figure 1:
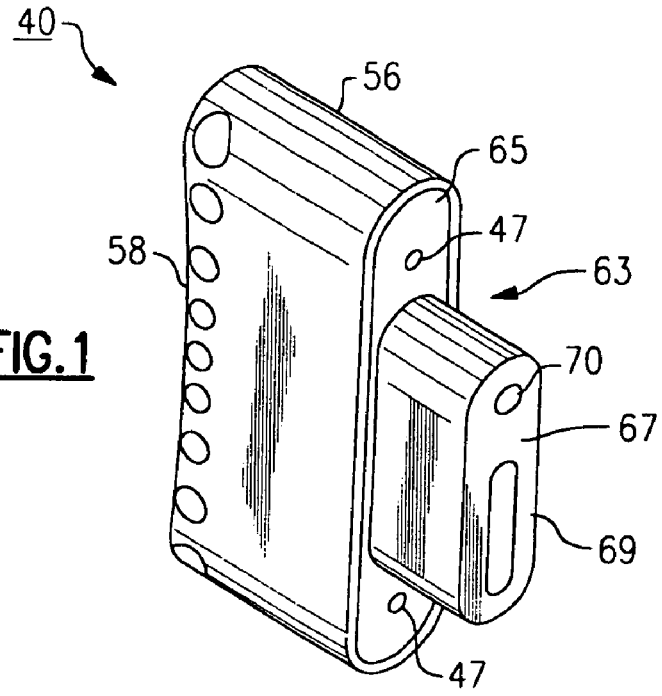
FIG. 1 is a first perspective view of a hydraulastic recoil pad made in accordance with a first embodiment of the present invention.
Figure 3:
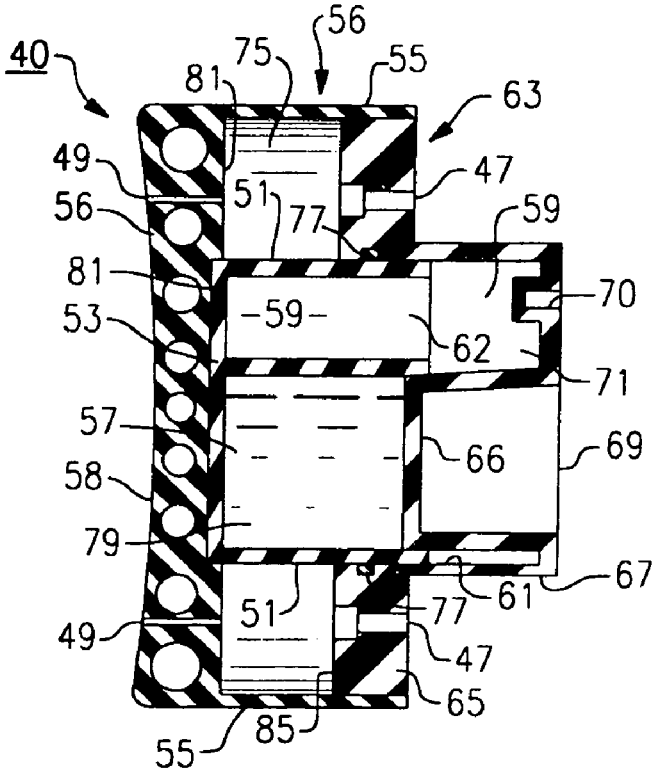
FIG. 3 is a side elevation view, taken in section through lines 3—3 of FIG. 2 of the hydraulastic recoil pad.
Figure 2:
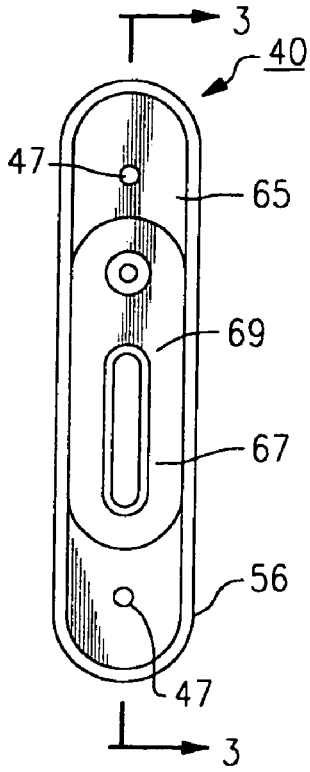
FIG. 2 is a front view of the hydraulastic recoil pad of FIG. 1.

Referring to FIGS. 1–3, there is shown a hydraulastic recoil pad 40 that is made in accordance with a first embodiment of the present invention. The pad 40 includes an elastomeric pad enclosure 56, made from an elastomer, including a proximal end side 58 which is preferably reinforced and shaped to conform to the shoulder of the shooter. An extending portion 55 of the elastomeric pad enclosure 56 is used to cover the remainder of the herein described apparatus, the pad enclosure including an interior cavity sized to receive a fitted chamber assembly 53 against a distal facing wall surface 81 of the reinforced proximal end side 58 thereof.

The chamber assembly 53 is preferably a plastic molded unitary component, including a pair of adjacent chambers, namely a first chamber 57 and an adjacent second chamber 59. Each of the first and second chambers 57, 59 are defined by side walls 51 defining each respective chamber, as well as a single open end 61, 62, each open end facing the distal side of the recoil pad 40. A piston assembly 63 is sized to be fitted onto the interior cavity of the elastomeric pad enclosure 56 at the distal side of the recoil pad 40 and in particular is fitted to cover the open ends 61, 62 of the first and second adjacent chambers 57, 59. The piston assembly 63 includes a base portion 65 supporting a center piston portion 67. The base portion 65 is defined by a plate-like planar portion which is fitted in the distal end of the elastomeric pad enclosure 56 and includes a pair of openings 47 that permit the recoil pad 40 to be assembled to the stock of a rifle by means of fasteners (not shown). The center piston portion 67 is a distal extension of the base portion 65 that includes a housing 69 having disposed therein a cylindrical or round piston head 66, as well as an adjacent interior cavity 71 defined by the exterior wall of the piston head and the interior wall of the housing 69 that covers the second chamber 59 wherein the confines of the second chamber and the interior cavity of the piston assembly combine to form an accumulator chamber. A quantity of a hydraulic fluid 79, such as silicone fluid, is added within the confines of the first chamber 57 to a predetermined level therein, the level being variable, the fluid being added by means of a fill port 70 which is provided on the exterior of the distal facing side of the center piston portion 67 of the piston assembly 63 and extending into the interior cavity 71 thereof and is sealed with a fill plug.

A spacing or gap 75 is provided between the proximal facing surface 85 of the base portion 65 and the distal facing surface 81 of the elastomeric pad enclosure 56 wherein interior walls of the base portion effectively covers the side walls 51 of the adjacent first and second chambers, 57, 59 respectively. An annular O-ring 77 or similar seal is further provided therebetween to provide an effective fluid-tight seal between the exterior of the fitted chamber assembly 53 and an interior surface of the base portion 65, the interior surface including an annular groove retaining the O-ring 77. The spacing 75 permits compression of the elastomeric pad enclosure 56 with the action of a recoil force, as described below.

Finally, a pair of access openings 49 extend through the proximal side of the elastomeric pad 56 and are axially aligned with the openings 47 provided in the base portion 65, thereby permitting adjustment/replacement of the recoil pad 40, as needed.

In operation, a recoil force supplied by the action of firing the rifle (not shown) causes the stock to move in a rearward direction (i.e., proximally) toward the shoulder of the shooter. This movement causes the attached base portion 65 of the recoil pad 40 to also be shifted in a rearward direction, due to the attachment of the base portion by fasteners (not shown) through openings 47 extending to the rifle stock. Similarly, the remainder of the piston assembly 63, including the center piston portion 67, is also caused to similarly translate towards the fixed position of the fitted chamber assembly 53 containing the two chambers 57, 59 attached to the interior surface of the elastomeric pad 56.

As a result of this latter movement, the elastomeric pad 56 is compressed with the piston head 66 being caused to move into the cavity of the first chamber 57. The volume of the first chamber 57 is therefore reduced and as a result hydraulic fluid 79 initially contained within the first chamber 57 is pressurized and displaced from the first chamber about the periphery of the piston head 66 to the adjacent accumulator chamber 59, 71 due to the relative movement between the piston head 66 and the recoil pad. As the piston head 66 is shifted laterally, the orifice area (that is, the area formed by the gap between the outside of the piston head 66 and the inside walls of the first chamber 57) can be decreased by tapering the outside of the piston head and therefore more force is required in order to move the hydraulic fluid 79. As a result, energy is absorbed by the hydraulic fluid 79 and transferred into heat rather than transferring the energy back into the firearm. The air in the adjacent accumulator column provides a restoring force in that the air is compressed in the accumulator chamber 59, 71 and is sealed to prevent fluid leakage, other than with the adjacent first chamber 57. Upon cessation of the recoil force, the force of the compressed air causes any displaced hydraulic fluid to be pushed back (i.e., distally) about the piston head 66 and into the confines of the first chamber 57 and further causes the piston assembly 63 to assume its initial position. The elastomeric pad 56 also assists in providing a repeatable restoring force for the recoil pad 40.

Figure 4:
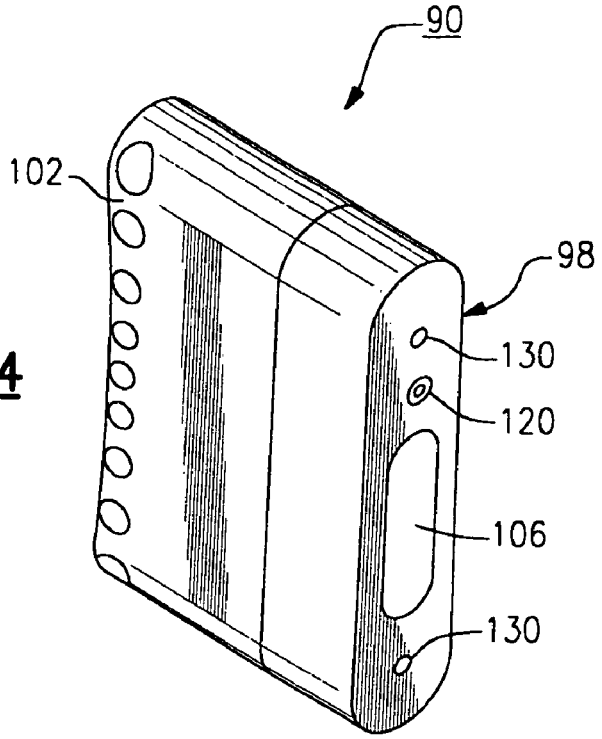
FIG. 4 is a front perspective view of a hydraulastic recoil pad made in accordance with a second embodiment of the present invention.
Figure 5:
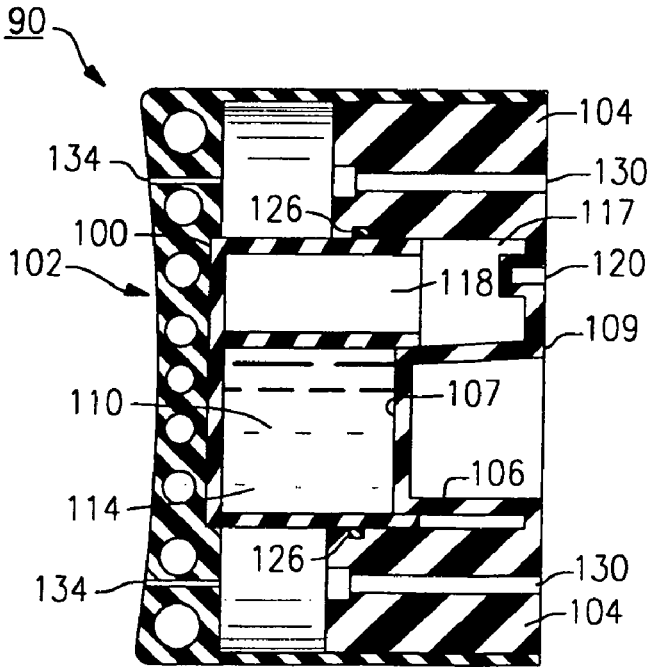
FIG. 5 is a side elevation view, taken in section, of the hydraulastic recoil pad of FIG. 4.
Figure 6:
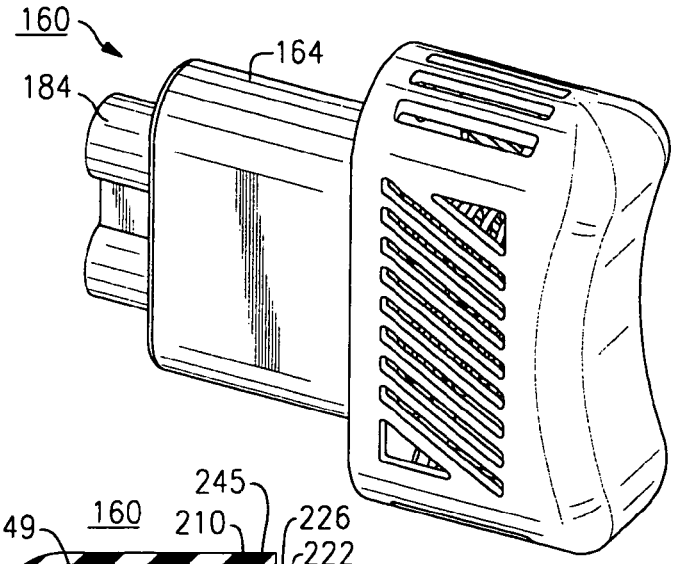
FIG. 6 is a perspective view of a hydraulastic recoil pad made in accordance with a third embodiment of the present invention.

It should be readily apparent that alternative designs that embody the above concepts are possible to those of sufficient skill in the field. For example, a second alternative embodiment to the recoil pad shown above is depicted in FIGS. 4 and 5.

Like the preceding design, the recoil pad 90 is defined by three (3) primary components; namely, a piston assembly 98, a fitted chamber assembly 100 and an elastomeric pad enclosure 102. The primary difference between the instant design and the design of the first embodiment is that the base portion 104 of the piston assembly 98 according to this embodiment extends coplanarly with the center piston portion 109 so that the recoil pad can be mounted directly to the end of the firearm stock, rather than integral thereto. Otherwise, the instant design performs in the same manner functionally wherein the piston assembly 98 includes a cylindrical or other suitably shaped piston head 106 which is placed initially into contact with the elastomeric pad 102, the piston being arranged in relation to a first interior chamber 110 that is at least partially filled with a hydraulic fluid 114, such as silicone fluid. As in the preceding embodiment, the first interior chamber 110 is filled to a predetermined level using a fill port 120 attached to the distal facing side of the piston assembly 98, permitting fluid movement when the cylindrical piston head 106 is moved therethrough.

As the entirety of the piston assembly 98, and more particularly the piston head 106, translates axially toward the proximal end of the apparatus 90 under the action of the recoil force of the firearm, the volume of the first chamber 110 is effectively reduced and the hydraulic fluid 114 contained in the first chamber 110 is pressurized by the proximal facing surface 107 of the piston head 106. As a result of this rearward movement and the noted fluid compression, a portion of the hydraulic fluid 114 in the first chamber 110 is caused to move around the entering piston head 106 into the adjacent accumulator chamber 118 formed between the exterior wall of the piston head 106 and the interior wall of the accumulator chamber. In the meantime, the variability of the orifice area formed by the gap created by the outside of the piston head 66 and the inside walls of the first interior chamber 110 produces damping based on the compressed hydraulic fluid 114 within the shrinking first chamber 110, effectively reducing the shock load provided against the shoulder of the shooter, the energy being dissipated into the fluid as heat which is then conducted into the environment.

The accumulator chamber is essentially formed from the interior of the second adjacent chamber 118 as well as that of the interior cavity 117 adjacent to the piston head 106 of the piston assembly 98. The volume of air that is retained within the accumulator chamber 117, 118 is also compressed due to the influx of hydraulic fluid 114 passing therein as well as the relative rearward movement of the recoil pad against the elastomeric pad 102, as braced by the shoulder of the shooter. The result is an elastomeric biasing force that biases the piston assembly 98 to return the piston assembly 98 to a neutral position upon cessation of the recoil force. This elastomeric biasing force further is sufficient to return the hydraulic fluid 114 back into the first interior chamber 110. The assembly 90 then assumes the initial or original prefired position shown in FIG. 5. It should be noted that in addition to the above, other return features, such as coil springs or the like (not shown), could also be provided to assist in providing a restoring force to the above apparatus.

Referring to FIGS. 6–9, a hydraulastic recoil pad made in accordance with a third embodiment of the present invention is herein described. The recoil pad 160, according to this embodiment, includes a body portion 164 defined by a substantially cylindrical shaped section, made preferably from a moldable plastic or another suitable material such as aluminum, the body portion having a formed interior cavity 168. The body portion 164 further includes an interior end wall 172 on a distal side 176 thereof wherein for purposes of this discussion, the "distal" side as referred to herein is that side of the recoil pad 160 which is attached to the rifle stock as opposed to the proximal side, the side which is adjacent to the shoulder of the shooter. The interior end wall 172 includes a pair of spaced through openings 180 which act as bearings for the piston rods 206, as well as a distal projecting portion 184.

A piston assembly 188 comprises a piston head 192, which according to this embodiment, is a disc-like member made from a suitable moldable plastic material, that is fitted within the formed interior cavity 168 of the body portion 164. Alternatively, however, other suitable lightweight materials can be used. The piston head 192 includes a pair of spaced through openings 196, 200 which are axially aligned with the above-noted openings 180 formed in the distal end wall 172 of the body portion 164. The above openings 180, 196, and 200 are sized to receive a corresponding pair of axial piston rods 206, the rods being preferably substantially round in cross-section. The piston rods 206 each extend in a parallel spaced relationship through the entirety of the body portion 164 of the herein described apparatus 160. A cylindrical bearing block 210 is fixedly attached to the open proximal end of the body portion 164, the bearing block being mounted adjacent to the piston head 192 and including an annular shoulder 214 which is received within a recess 218 formed in the proximal end of the body portion 164 in which the block is fixedly mounted. The bearing block 210 includes a pair of spaced openings 211 extending through the block that are sized to receive the axial piston rods that extend therethrough, the block further including flanges 217 extending from a proximal end thereof through which the rods further extend rearwardly. The bearing block 210 is also preferably formed from a suitable plastic, or other lightweight materials could easily be utilized.

The bearing block 210 is defined with an O-ring 222, which is provided in an annular groove 226 along an outer peripheral portion thereof, the O-ring engaging with the interior surface wall of the body portion 164 in order to form a fluid-tight seal. Likewise, the piston head 192 similarly includes an O-ring 230 that is provided in an annular groove 234 on the outer periphery thereof, the O-ring also engaging the interior wall surface of the interior cavity 168 of the body portion 164 in order to provide an effective fluid-tight seal therewith. If an annular orifice is used, the O-ring 230 and the annular groove 234 are removed and fluid is permitted to flow about the piston head 192. Alternatively, an orifice opening 285 or openings in the piston head 192 can be employed to orifice hydraulic fluid from one side of the piston head 192 to the other side thereof.

The axial piston rods 206 each extend proximally from the openings 211 formed in the bearing block 210 and outwardly from the flanges 217 extending from the proximal end thereof, the proximal ends of the piston rods being seated into a pair of receiving mounts 250 that are formed on the distal side of a plate member 248. The plate member 248 is spaced a predetermined distance from the proximal end wall of the body portion 164, as shown more clearly in FIG. 9. The piston rods 206 are fixedly secured within the receiving mounts 250, such as by means of a pair of cap screws 256 that are secured through corresponding recessed openings 260, each opening being accessed from on the proximal side of the plate member 248. Securement is made through threaded openings that are provided in the proximal ends of each axial piston rod 206. The piston rods 206 also each including O-ring seals 280, 284 that are respectively provided within the openings 211 between the piston rod and the bearing block 210 as well as within the openings 180 between the distal side of the body portion 164 and the piston rod to provide a fluid-tight enclosure for the interior cavity 168. According to this embodiment, each of the piston rods includes a circumferential slot into which the O-ring 280, 284 is fitted, the O-rings then engaging with the interior wall of the openings 211 and 180, respectively.

A pair of coil springs 272 are attached in overlaying relation relative to the predetermined spaced area 276 that is defined between the plate member 248 and the body portion 164, each coil spring being mounted onto a corresponding piston rod 206 and secured at either end to the exterior of the receiving mounts 250 and the flanges 217. The recoil pad 160 is shown in an initial position in FIG. 7. In this initial position, the coil springs 272 are biased to maintain the predetermined spacing 276 between the proximal end wall of the bearing block 210 and the plate member 248.

An elastomeric pad covering 224, made from an elastomeric material, is provided that covers the proximal end of the body portion 164 as well as the plate member 248 and the predetermined spaced area 276. Preferably, the elastomeric pad covering 224 is reinforced and shaped along the proximal end thereof so as to contour to the shoulder of the shooter, as shown most clearly in FIG. 6.

The recoil pad 160, according to this embodiment, is attached to the butt end of a rifle stock (not shown) through a pair of spaced openings 245 that are provided in a proximal end wall 189 of the body portion 164, the end wall being disposed radially outboard of the seated bearing block 210. Access holes 249 are further provided in the plate member 248 that are axially aligned with the openings 245 to permit access to fasteners (not shown) securing same so as to permit removal/replacement, as needed.

The interior cavity 168 formed by the body portion 164 between the distal side of the piston head 192 and the interior distal end wall 172 of the body portion 164 is sized to define a fluid chamber which is initially filled to a predetermined level with a hydraulic fluid, such as silicone fluid, (not shown) by means of a fill port (not shown). The fill port and fill plug can be sealingly provided in the bearing block 210 or can otherwise be provided.

As noted, the axial piston rods 206 are substantially cylindrical and include a common cross section with the exception of the annular grooves formed to receive the above-noted O-ring seals. In addition, an axial portion 209 of each piston rod extending through the piston head 192 is made with a smaller or narrowed diameter than the remainder of the piston rod 206. The design shown incorporates a piston head 192 that is molded around the piston rods 206. The smaller diameter on the piston rods 206 provides a bearing area to transfer load from the piston head 192 to the piston rods 206. Other types of connections between the piston head 192 and the piston rods 206, such as a threaded connection, can also be employed without deviating from the intended scope of the invention.

Still referring to FIGS. 6–9, the operation of the recoil pad 160 will now be described in greater detail. Upon discharge of the rifle, the butt end of the rifle stock (not shown) shifts laterally toward the shoulder of the shooter; that is, toward the proximal side of the recoil pad 160. This axial movement causes a corresponding axial movement of the body portion 164 due to the fixed attachment of the body portion 164 to the rifle through the openings 245 by means of fasteners (not shown). This latter movement causes an axial force to be imparted on the coil springs 272 against the plate member 248 which is supported by the elastomeric pad 224 resting against the shoulder of the shooter (not shown). The resulting axial force causes movement of the body portion 164 relative to the piston head 192 which is fixed to the piston rods 206 and the plate member 248, the latter being supported by the elastomeric pad 224 resting against the shoulder of the shooter. As this relative movement occurs, hydraulic fluid contained within the interior body cavity 168 is caused to move through the orifice hole 285 in the piston head 192, causing displacement of the fluid from the distal side of the piston head 192 to the proximal side of the piston head. This displacement of the hydraulic fluid provides resistance and therefore dampens the recoil force which is transmitted to (i.e., felt by) the shooter. The fluid-tight seals which are provided in the piston rods 206, the piston head 192 and the bearing block 210 permit the fluid from migrating other than through the orifice hole 285 provided in the piston head 192, maintaining the fluid within the interior cavity 168.

Figure 7:
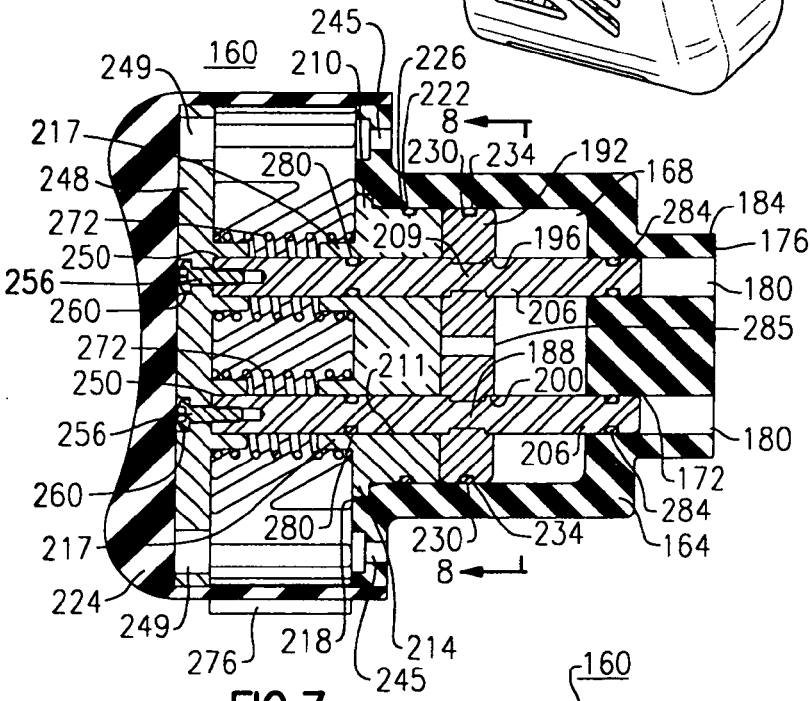
FIG. 7 is a side elevation view of the hydraulastic recoil pad of FIG. 6, taken in section.
Figure 8:
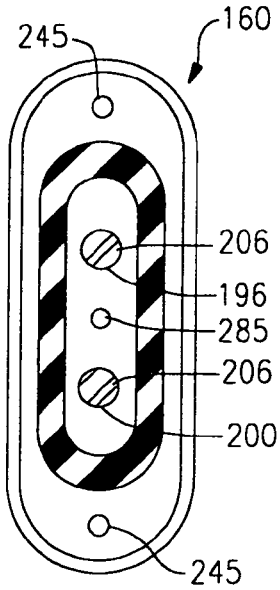
FIG. 8 is a sectioned view taken through lines 8—8 of FIG. 7.
Figure 9:
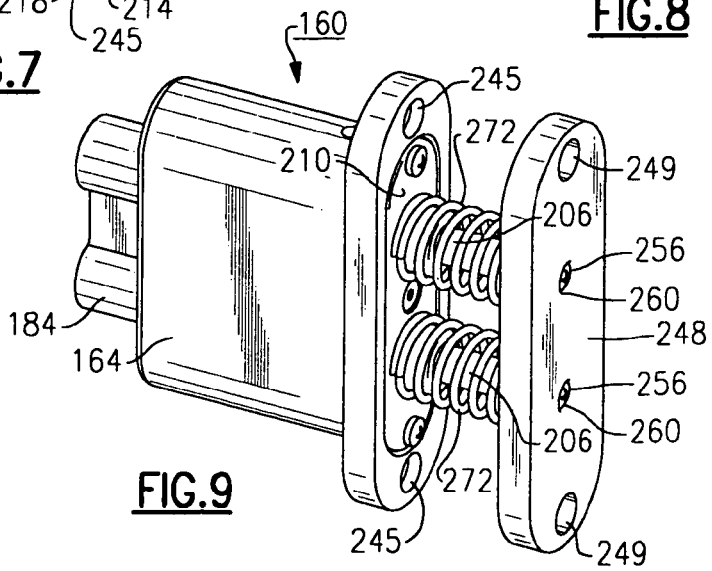
FIG. 9 is a partial side isometric view of the interior of the hydraulastic recoil pad of FIGS. 6–8.

In the meantime, the initial biasing force of the coil springs 272 that are fixedly secured to the plate member 248 provide a centered restoring force in order to cause the body portion 164 to be shifted back to the initial position of FIG. 7 following application of the recoil force. As the bearing block 210 is caused to move under the biasing force of the coil springs 272, the hydraulic fluid is again caused to migrate through the orifice opening 285 in the piston head 192, causing the body portion 164 to shift laterally toward the gun stock (or distal side of the recoil pad 160)-until the piston head is again directly adjacent to the bearing block 210.

It should be realized that the particular recoil pad design can be modified to achieve the same function. For example, and rather than displacing hydraulic fluid through an orifice hole or opening 285 or openings, the O-rings located on the periphery of the piston head 192 could be removed in favor or providing the same orifice area as the orifice opening 285 in the piston head. As such hydraulic fluid would be then be directed around the periphery of the piston head 192, as the piston head translates axially through the chamber.

While the present invention has been particularly shown and described with reference to the preferred mode as illustrated in the drawings, it will be understood by one skilled in the art that various changes in detail may be effected therein without departing from the spirit and scope of the invention as defined by the claims.

PARTS LIST FOR FIGS. 1–9

40 recoil pad
47 openings
49 access openings
51 side walls
53 fitted component assembly
55 extending portion
56 elastomeric pad
57 first chamber
58 proximal end side
59 second chamber
61 open end
61 open end
63 piston assembly
65 base portion
66 piston head
67 center piston portion
69 housing
70 fill port
71 interior cavity
75 spacing
77 O-ring
79 hydraulic fluid
81 distal facing wall surface
85 proximal facing surface-base portion
90 recoil pad
98 piston assembly
100 fitted component assembly
102 elastomeric pad enclosure
104 base portion
106 piston head
107 proximal facing surface
109 center piston portion
110 first interior chamber
114 hydraulic fluid
117 interior cavity
118 second interior chamber
120 fill port
126 O-ring
130 opening
134 access openings
160 hydraulastic recoil pad
164 body portion
168 interior cavity
172 end wall
176 distal end
180 openings
184 projecting portion
188 piston assembly
192 piston head
196 opening
200 opening
206 piston rods, axial
209 narrowed axial portion
210 bearing block
211 openings
214 annular shoulder
217 proximal end, body portion
218 recess
222 O-ring
224 elastomeric pad
226 annular groove
230 O-ring
234 annular groove
245 openings, spaced
248 plate member
249 access holes
250 mounts
256 cap screws
260 openings
272 coil springs
276 spacing
280 O-ring
284 O-ring
285 orifice opening or hole Though the present invention has been described in terms of certain embodiments, it will be readily apparent to one of sufficient skill in the field that modifications and variations can be made using the inventive concepts described herein according to the following claims.

We claim:

1. A recoil pad for a shoulder firearm, said recoil pad comprising:

a body portion fixedly attached to said firearm, said body portion having at least one chamber at least partially filled with a hydraulic fluid;

a piston contained within said body portion, said piston being axially movable from a first axial position to a second axial position that extends said piston into said at least one chamber and into contact with the hydraulic fluid when the firearm is discharged and a recoil force is imparted thereto; and restoring means for automatically moving said piston to the first axial position after the recoil force is no longer acting upon said piston wherein movement of said piston into the at least one chamber decreases the volume of the chamber by orificing fluid through or around the piston, therefore creating a resistance so as to absorb energy imparted thereto, said restoring means comprising an elastomeric pad shaped for fitting to the shoulder of a shooter.

2. A recoil pad as recited in claim 1, wherein said restoring means further includes at least one coil spring.

3. A recoil pad as recited in claim 1, wherein said at least one restoring means includes a volume of compressible gas into which the hydraulic fluid is displaced when said piston is moved from the first axial position to the second axial position.

4. A recoil pad as recited in claim 3, wherein said piston moves through a first chamber containing hydraulic fluid, said piston including means for permitting hydraulic fluid to be displaced from said first chamber to said second chamber as said piston is moved through said towards said second axial position.

5. A recoil pad as recited in claim 4, wherein said second chamber contains a fluid tight seal other than with said first chamber and includes a volume of air, said volume of air comprising said volume of compressible gas being compressed when the predetermined volume of hydraulic fluid is forced from said first chamber into said second chamber.

6. A recoil reducing apparatus for a shoulder firearm, said apparatus comprising:

a body portion adapted to be fixedly secured to the stock of a firearm, said body portion including an interior fluid cavity at least partially filled with a hydraulic fluid;

a piston assembly including a piston head which is axially movable through said interior fluid cavity between a first axial position and a second axial position when a recoil force is imparted to said apparatus and at least one fixedly secured piston rod extending through an opening formed in said piston head; and restoring means for moving said piston head back to said second axial position when the recoil force is no longer applied wherein movement of said piston head causes movement of hydraulic fluid through or around said piston head within said interior fluid cavity, said restoring means including an elastomeric pad enclosure overlaying substantially the entirety of said body portion, a proximal end portion of said elastomeric pad enclosure being shaped to conform to the shoulder of a shooter of the firearm.

7. A recoil pad as recited in claim 6, wherein said piston head includes at least one orifice wherein movement of said piston head between said first axial position and said second axial position causes hydraulic fluid to be displaced from one side of said piston head to the opposite side of said piston head in said interior fluid cavity.

8. A recoil pad as recited in claim 7, wherein said restoring means includes at least one coil spring.

9. A recoil pad as recited in claim 8, wherein said at least one coil spring is disposed in overlaying fashion onto an extending portion of said at least one piston rod.

10. A recoil pad as recited in claim 9, wherein the extending portion of said at least one piston rod is fixedly attached to one side of a plate member.

11. A recoil pad as recited in claim 10, wherein said plate member and the proximal end of said body portion are separated by a predetermined spacing.

12. A recoil pad as recited in claim 6, wherein hydraulic fluid is caused to move around said piston head when said piston head is moved between said first axial position and said second axial position.

13. A recoil pad as recited in claim 5, wherein said piston head is movable through said first chamber to move hydraulic fluid into said second chamber which is adjacent and arranged parallel to said first chamber.

14. A recoil pad as recited in claim 5, wherein said piston head has a tapered configuration.

* * * * *